US008311431B2

(12) United States Patent
Deguchi et al.

(10) Patent No.: US 8,311,431 B2
(45) Date of Patent: Nov. 13, 2012

(54) IMAGE FORMING APPARATUS COMPRISING A CONTROL SECTION CONFIGURED TO CARRY OUT A CONTROL PROCESS INCLUDING SETTING A POWER SAVING MODE

(75) Inventors: Masanobu Deguchi, Nara (JP); Kyosuke Taka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/325,460

(22) Filed: Dec. 14, 2011

(65) Prior Publication Data

US 2012/0087682 A1 Apr. 12, 2012

Related U.S. Application Data

(62) Division of application No. 12/424,022, filed on Apr. 15, 2009, now abandoned.

(30) Foreign Application Priority Data

Apr. 22, 2008 (JP) ..... 2008-111270

(51) Int. Cl.
*G03G 15/20* (2006.01)
*G03G 15/00* (2006.01)

(52) U.S. Cl. ..... 399/68; 399/67; 399/69; 399/70; 399/43

(58) Field of Classification Search ..... 399/43, 399/68, 69, 70
See application file for complete search history.

(56) References Cited

U.S. PATENT DOCUMENTS 6,393,233 B1 5/2002 Soulier
6,580,884 B2 6/2003 Kuwabara
2002/0012543 A1 1/2002 Nakamura et al.
2007/0071467 A1 3/2007 Mitsuya et al.
2007/0092277 A1 4/2007 Miyata et al.
2007/0110464 A1 5/2007 Nakayama et al.
2007/0196119 A1 8/2007 Fujita
2007/0264039 A1 11/2007 Saito et al.
(Continued)

FOREIGN PATENT DOCUMENTS

JP 10-268696 10/1998
(Continued)

OTHER PUBLICATIONS

Machine translation of JP2005-003818.*
(Continued)

*Primary Examiner* — Walter L Lindsay, Jr.
*Assistant Examiner* — David Bolduc
(74) *Attorney, Agent, or Firm* — Renner, Otto, Boisselle & Sklar, LLP

(57) ABSTRACT

An image forming apparatus includes a counting section, a storage section, a control section, and a driving member control section. The counting section counts the number of recording media subjected to successive printing. The storage section stores the number counted by the counting section. The control section performs a control process including: setting a power saving mode by selecting a printing speed of the fixing section which is lower than a preset normal speed used in the normal mode while selecting a preset fixing temperature of the fixing section which is lower than a preset normal temperature used in the normal mode when the normal mode is alive while a frequency of successive printing on not more than three recording media is a predetermined percentage or more. The driving member control section switches a current printing speed of the fixing section to a printing speed selected by the control section.

4 Claims, 9 Drawing Sheets

U.S. PATENT DOCUMENTS

| | | | |
|---|---|---|---|
| 2008/0267644 | A1 | 10/2008 | Murakami |
| 2009/0035004 | A1 | 2/2009 | Suguira |

FOREIGN PATENT DOCUMENTS

| | | |
|---|---|---|
| JP | 2000-137407 | 5/2000 |
| JP | 2001-356616 | 12/2001 |
| JP | 2005-003818 | 1/2005 |
| JP | 2006-038916 | 2/2006 |

OTHER PUBLICATIONS

Machine translation of JP2001-356616.*

Co-pending U.S. Appl. No. 12/424,022 filed Apr. 15, 2009.

* cited by examiner

Fig.3

| | PRINTING SPEED | |
|---|---|---|
| | NORMAL SPEED (225mm/s) | LOW SPEED (125mm/s) |
| FIXING TEMPERATURE | NORMAL TEMPERATURE (185° C) | LOW TEMPERATURE (165° C) |
| | PLAIN SHEET | THICK SHEET |
| | THIN SHEET | PRINTING ON THREE OR LESS PLAIN SHEETS |

IMAGE FORMING APPARATUS COMPRISING A CONTROL SECTION CONFIGURED TO CARRY OUT A CONTROL PROCESS INCLUDING SETTING A POWER SAVING MODE

CROSS REFERENCE

This Nonprovisional application claims priority under 35 U.S.C. §119(a) on Patent Application No. 2008-111270 filed in Japan on Apr. 22, 2008, the entire contents of which are hereby incorporated by reference.

BACKGROUND OF THE INVENTION

The present invention relates to an image forming apparatus configured to carry out an electrophotographic image forming process, such as a copier, printer or facsimile apparatus, a printing method applicable to such an image forming apparatus, and a computer program for implementing a printing process carried out by such an image forming apparatus.

An electrophotographic image forming apparatus is configured to form an image by a process including: forming an electrostatic latent image by exposing a surface of a photosensitive member in an electrostatically charged condition to signal light in accordance with image information; forming a toner image by supplying toner to the electrostatic latent image; and transferring and fixing the toner image to a recording medium.

In fixing the toner image onto the recording medium, a fixing device is used which includes, for example, a fixing roller and a pressurizing roller pressed against the fixing roller. The recording medium introduced between pressure-contact portions of the fixing roller and pressurizing roller is heated and pressurized, so that the toner image is fixed onto the recording medium.

To meet growing printing speed, a method of increasing the amount of heat or a method of increasing the pressure to increase the fixing nip pressure is applied to the fixing device. Increasing the amount of heat, however, is against the recent energy saving trend and, in addition, raises a problem that a printing sheet just delivered is so hot that a human cannot touch the printing sheet. As a result, cooling means, such as a cooling fan, becomes necessary.

In recent color printing, toners for respective colors (i.e., yellow, magenta, cyan and black) are stacked on a recording medium. The thickness of a toner stack of three color toners developing black is about 40 μm (inclusive of air), whereas the thickness of one monochrome toner layer is about 14 μm. In order to fix such a toner stack having particle diameters of about 6 μm onto the recording medium by the heat of the fixing roller surface, it is necessary to increase the heat and the pressure, as well as to remove air having high heat insulation to reduce the spacing between each toner particle and the fixing roller. This results in likelihood of the occurrence of toner offset in color printing in particular. Under actual circumstances, the occurrence of toner offset is suppressed by remedies including: adding wax to the toners or increasing the amount of wax to be added; and using a fluoro-type tube for the fixing roller. Since a toner in a state before fixing bears air, color printing requires a larger amount of heat and a higher pressure than monochrome printing.

Printing sheets as recording media include those containing rough fibers and those having smooth surfaces such as a coated paper sheet. In fixing a toner to a printing sheet containing rough fibers, the printing sheet calls for a larger amount of heat and a higher pressure as its texture becomes rougher.

Therefore, the image forming apparatus is configured to change the fixing conditions in accordance with the type of recording media to be used. Specifically, the fixing temperature in a thin sheet mode is a preset fixing temperature lower than a normal fixing temperature because the amount of heat to be applied can be reduced, while the printing speed in a thick sheet mode is preset lower than a normal printing speed because the amount of heat for fixing is insufficient.

In ensuring a usual fixing performance on plain paper sheets in general, the fixing temperature has to be set within a range from 180° C. to 190° C. However, the temperature of the fixing roller has to be raised to such a fixing temperature from about room temperature in a state assumed just after power has been turned ON or in a state of being resumed from a sleep mode and, hence, a considerable warm-up time is necessary in such a case. In order to shorten such a warm-up time, measures have been taken which include: changing the fixing system from a roller type system to a belt type system; and lowering the melting point of a toner. Alternative measures to shorten the warm-up time having been taken include adding an auxiliary lamp to be used at the time the fixing temperature starts rising. Such measures are forced to increase the power consumption.

An electrophotographic apparatus described in Japanese Patent Laid-Open Publication No. 2001-356616 is configured to shorten the fixing roller warm-up time by shortening the start-up waiting time before printing on a small number of printing sheets ranging from one to a few sheets in order to make a first printing time earlier.

Users, in general, wish the printing operation to start promptly in the state assumed just after power has been turned ON or in the state of being resumed from the sleep mode. If the apparatus assumes a state in which image forming processing is inhibited (i.e., standby state) in spite of a user wishing prompt copying or data output, the user will be displeased.

If a state in which an instruction to proceed with the image forming process can be accepted (i.e., ready state) is assumed before the preset fixing temperature is reached, the user will not be displeased. Thus, an image forming apparatus satisfying the user can be provided.

Actual printing jobs mostly include jobs of performing printing on a few printing sheets at most, though there are a few jobs of performing printing on a large number of printing sheets up to several hundred printing sheets. For this reason, the user is fed up with such a long waiting time very much.

The electrophotographic apparatus described in Japanese Patent Laid-Open Publication No. 2001-356616, which is capable of early printing for the purpose described above, is based on the precondition that the number of printing sheets to be subjected to printing is small and hence is incapable of accommodating a large number of printing sheets to be used for printing.

In view of the foregoing problems, a feature of the present invention is to provide an image forming apparatus which is capable of starting image formation early while enabling an image forming process to be carried out on a large number of printing sheets.

SUMMARY OF THE INVENTION

According to the present invention, the image forming apparatus includes a fixing section, a temperature control section, and a display section. The fixing section is configured to fix a developing agent image carried on a recording medium onto the recording medium by heat supplied from a heat source. The temperature control section is configured to control a fixing temperature of the fixing section so as to adjust the fixing temperature to a preset fixing temperature. The display section is configured to display a current printing mode being used.

In addition, the image forming apparatus according to the present invention can set plural printing modes including a normal mode for printing on a recording medium having a normal thickness other than recording media having specific thicknesses including a thick recording medium and a thin recording medium, and has not less than two printing speeds and not less than two preset fixing temperatures in the fixing section.

Furthermore, the image forming apparatus according to the present invention includes a counting section, a storage section, a control section, and a driving member control section. The counting section is configured to count the number of recording media having been subjected to successive printing. The storage section is configured to store therein the number counted by the counting section. The control section is configured to carry out a control process including: setting a power saving mode by selecting a printing speed of the fixing section which is lower than a preset normal speed used in the normal mode while selecting a preset fixing temperature of the fixing section which is lower than a preset normal temperature used in the normal mode when the normal mode is alive while a frequency of successive printing on not more than three recording media is a predetermined percentage or more. The driving member control section is configured to switch a current printing speed of the fixing section to a printing speed selected by the control section.

BRIEF DESCRIPTION OF THE DRAWINGS

FIG. 3 is a table showing a relationship between a fixing temperature and a printing speed in an image forming apparatus according to an embodiment of the present invention;

DETAILED DESCRIPTION OF THE INVENTION

Hereinafter, an image forming apparatus according to the best mode for carrying out the present invention will be described in detail with reference to the drawings.

Figure 1:
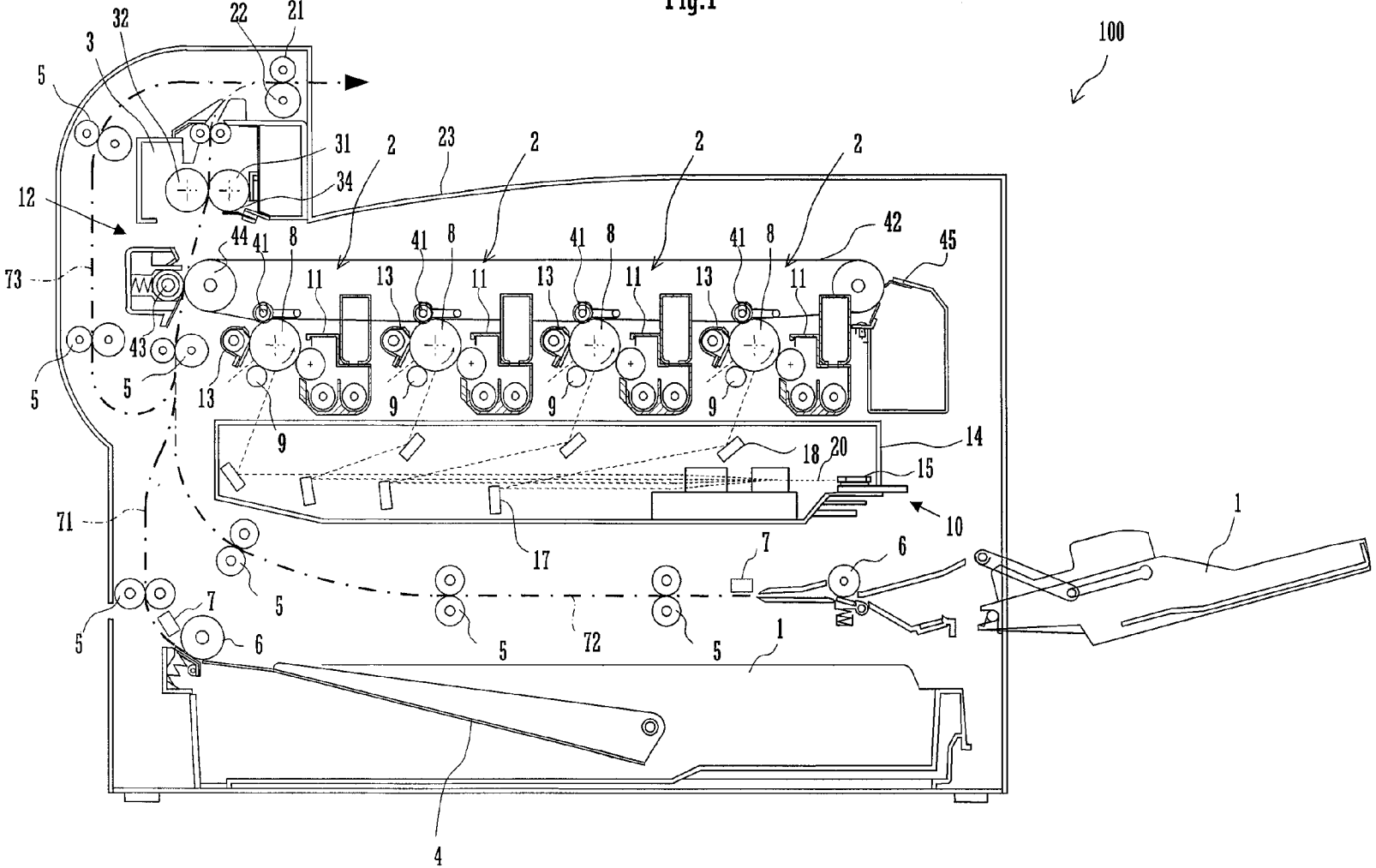
FIG. 1 is a view showing a structure of an image forming apparatus according to an embodiment of the present invention.

FIG. 1 is a view showing a structure of an image forming apparatus according to an embodiment of the present invention.

An image forming apparatus 100 is a printer for processing image data inputted from the outside and outputting the image data as a hard copy. The image forming apparatus 100 may be used as a copier if a device for reading a document image, i.e., scanner (image reading device), is provided on the printer.

The image forming apparatus 100 comprises a sheet feeding section 1 configured to store and feed printing sheets as recording media on each of which a toner image is finally formed, an image forming section 2 including a developing device 11 configured to form such a toner image on a printing sheet by transferring the toner image to the printing sheet, and a fixing device 3 configured to fuse and fix the transferred toner image onto the printing sheet.

The sheet feeding section 1 includes a sheet feeding tray 4 placed in a lower portion of the image forming apparatus 100, a pickup roller 5 for feeding a multiplicity of printing sheets stored in the sheet feeding tray 4 one by one, a separating member 6 for restraining printing sheets positioned under a printing sheet which is about to be fed thereby allowing one-by-one feeding to be realized, and a like component. Each printing sheet fed from the sheet feeding section 1 is fed to a transfer position in the image forming section 2 by means of a guide and the like. A sheet detection sensor 7 for detecting a printing sheet being fed is located at an intermediate point on a path on which the printing sheet is fed to the transfer position.

The sheet detection sensor 7 generates a detection signal upon detection of the leading edge of a printing sheet. Such a detection signal is processed as a signal for causing the image forming section 2 to start its image forming operation. Such processing is control processing for making the starting edge of a toner image to be formed by the image forming section 2 meet the leading edge of the printing sheet. A control for driving the pickup roller 5 and the like is performed in a manner timed with the control processing.

The image forming section 2 includes a drum-shaped photosensitive member 8 as an image carrier for forming and carrying a toner image thereon. Generally, such a photosensitive member 8 is formed by coating a surface of a conductive cylindrical drum with a photoconductive layer. The photosensitive member 8 may have an endless belt shape instead of the drum shape.

In the image forming section 2 there are disposed an electrostatic charger 9, exposure device 10, developing device 11, transfer device 12, cleaning device 13 and the like in that order from the upstream side in the direction of rotation of the photosensitive member 8. The electrostatic charger 9 electrostatically charges the surface of the photosensitive member 8. The exposure device 10 irradiates the surface of the photosensitive member 8 with a light beam forming an optical image in accordance with image data. The developing device 11 develops an electrostatic latent image formed by irradiation with the optical image into a visible toner image. The transfer device 12 includes an intermediate transfer roller 41, intermediate transfer belt 42, transfer roller 43, intermediate transfer belt driving roller 44, and belt cleaning device 45. The transfer device 12 transfers the toner image thus formed to a printing sheet. The cleaning device 13 cleans off residual toner which remains on the surface of the photosensitive member 8 after the transfer operation.

The transfer position is a position at which the transfer roller 43 and the intermediate transfer belt driving roller 44 are pressed against each other and to which a printing sheet fed from the sheet feeding section 1 is fed in a timing controlled manner.

The exposure device 10 irradiates the photosensitive member 8 in an exposed position with a laser beam 20 by controlling the ON-OFF operation of a semiconductor laser in accordance with image data inputted from other external equipment to the image forming apparatus 100. For this purpose, the exposure device 10 includes a light-emitting unit 14 for controlling the ON-OFF operation of the semiconductor laser in accordance with the image data, scanning mirror 15, and reflecting mirrors 17 and 18.

The scanning mirror 15 rotates at a high and fixed speed. The surface of the photosensitive member 8 is selectively irradiated with the laser beam 20 which is emitted from the light-emitting unit 14 to form an optical image in accordance with the image data. Thus, an electrostatic latent image in accordance with the laser beam thus emitted is formed on the surface of the photosensitive member 8 uniformly charged by the electrostatic charger 9.

The electrostatic latent image thus formed on the photosensitive member 8 is developed into a toner image (i.e., developing agent image) as a visible image by the toner stored in the developing device 11. The toner image is transferred to a printing sheet fed from the sheet feeding section 1 to the transfer position by the action of the transfer roller 43. As described above, the printing sheet is detected by the sheet detection sensor 7 and then fed to the transfer position at which the intermediate transfer belt driving roller 44 and the transfer roller 43 are pressed against each other in such a timing controlled manner that the leading edge of the printing sheet meets the starting edge of the toner image formed on the photosensitive member 8, in response to the detection by the sheet detection sensor 7.

The toner image on the surface of the photosensitive member 8 is intermediately transferred to the intermediate transfer belt 42 by being applied with a transfer bias by the intermediate transfer roller 41. The toner image thus intermediately transferred is fed to the transfer position at which the intermediate transfer belt driving roller 44 and the transfer roller 43 are pressed against each other.

The toner partially remains on the intermediate transfer belt 42 having been finished with the transfer operation. Such residual toner is removed by the belt cleaning device 45. Thus, the intermediate transfer belt 42 becomes ready for the next intermediate transfer operation.

After the intermediate transfer, the toner partially remains on the surface of the photosensitive member 8. Such residual toner is removed by the cleaning device 13. Thus, the photosensitive member 8 becomes ready for the next image formation.

On the other hand, the printing sheet having been subjected to the transfer is peeled off the photosensitive member 8 and then fed into the fixing device 3 located downstream in the feeding direction. The toner image transferred to the printing sheet is fused and fixed to the surface of the printing sheet as the printing sheet is passed and fed through the fixing device 3.

The printing sheet having passed through the fixing device 3 is then delivered to the outside of the image forming apparatus by means of a delivery roller 21, 22 placed on a delivery path. A catch tray 23 is provided at the location to which the printing sheet is delivered for receiving the printing sheet with its image-formed side oriented down. Reference numerals 71, 72 and 73 designate sheet feeding paths passing by way of the sheet feeding section 1, the transfer position, fixing device 3 and delivery roller 21, 22.

Figure 2:
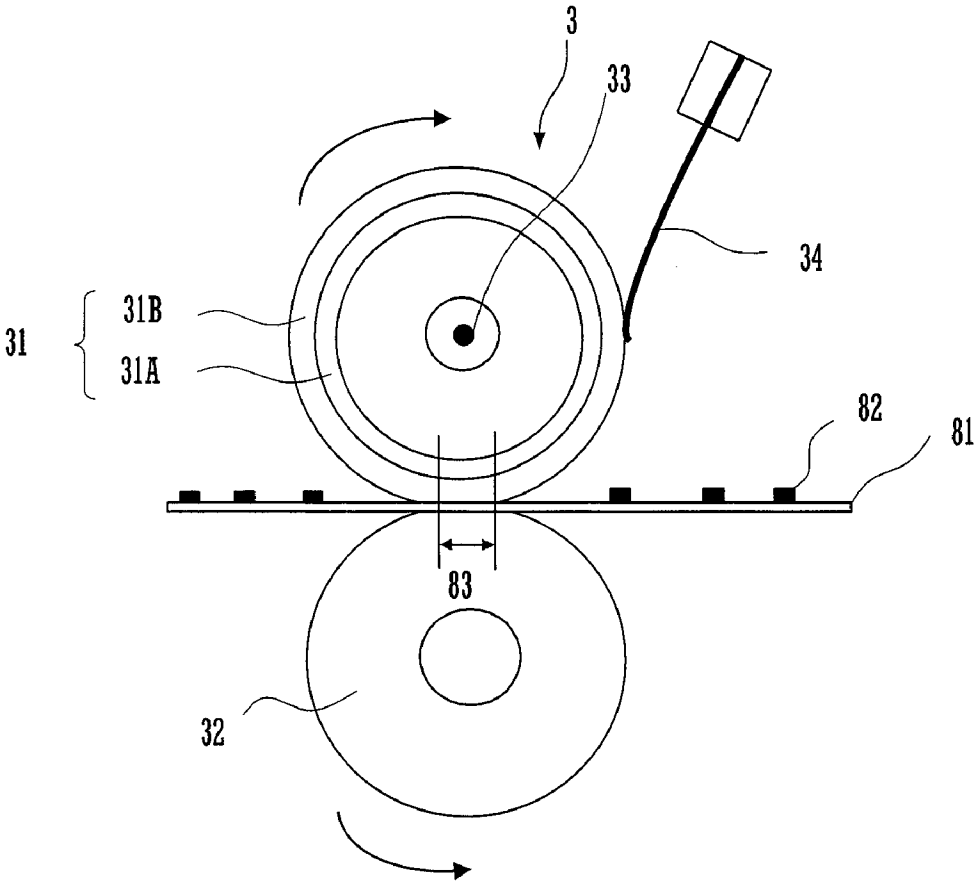
FIG. 2 is a view showing an arrangement of a fixing device in an image forming apparatus according to an embodiment of the present invention.

FIG. 2 is a view showing an arrangement of a fixing device in an image forming apparatus according to an embodiment of the present invention.

The fixing device 3 includes a fixing roller (i.e., fixing section) 31 having therein a heater lamp 33 comprising a halogen lamp as a heat source, and a pressurizing roller 32 pressurizing the fixing roller 31 at a predetermined pressure.

The fixing roller 31 comprises a cylindrical core 31A formed of a metal, such as aluminum or carbon steel, and a coating layer 31B covering the core 31A, the coating layer 31B comprising a material having a high release property relative to toner. The surface temperature of the fixing roller 31 is detected by a temperature detection sensor 34, such as a thermistor, while the power to the heater lamp 33 is controlled by a temperature control circuit (i.e., temperature control section) in such a manner that the surface temperature of the fixing roller 31 is adjusted to a temperature that allows the toner to be fixed.

In the fixing device 3 thus arranged, a printing sheet 81 as a recording medium carrying an unfixed toner image 82 thereon is passed through a pressure contact region 83 in which the fixing roller 31 and the pressurizing roller 32 are pressed against each other, to fix the toner image 82 onto the printing sheet 81 by fusion and pressure.

In the fixing device 3 having the above-described arrangement, when the main power of the image forming apparatus 100 is turned ON, the heater lamp 33 starts being energized, while a start-up control is performed so that the temperature of the fixing roller 31 is adjusted to a preset fixing temperature which allows toner to be fixed. When the image forming apparatus 100 is under normal temperature and humidity conditions, the fixing device 3 can start up within a start-up time period fixed to some extent.

FIG. 3 is a table showing a relationship between a fixing temperature and a printing speed in an image forming apparatus according to an embodiment of the present invention.

The image forming apparatus 100 uses two fixing temperatures of 185° C. and 165° C. and two printing speeds of 225 mm/s and 125 mm/s. The fixing temperature of 185° C. is a preset normal temperature. The printing speed of 225 mm/s is a preset normal speed. The image forming apparatus 100 can set three printing modes by combining these conditions. The three printing modes include: a normal mode in which the fixing temperature and the printing speed are 185° C. and 225 mm/s, respectively; a thick sheet mode in which the fixing temperature and the printing speed are 185° C. and 125 mm/s, respectively; and a thin sheet mode in which the fixing temperature and the printing speed are 165° C. and 225 mm/s, respectively. In printing on a plain sheet for use in normal printing, the normal mode is selected. In printing on a thick sheet which is thicker than the plain sheet, the thick sheet mode is selected. Since the amount of heat for fixing toner onto a printing sheet is likely to become insufficient in printing on the thick sheet, the printing speed in the thick sheet mode is set lower than that in the normal mode. In printing on a thin sheet which is thinner than the plain sheet, the thin sheet mode is selected. Since the amount of heat for fixing toner onto a printing sheet is likely to become excessive in printing on the thin sheet, the fixing temperature in the thin sheet mode is set lower than that in the normal mode.

Besides the above-described three modes, the image forming apparatus 100 is capable of printing in an initial normal mode in which the fixing temperature and the printing speed are 165° C. and 125 mm/s, respectively. The initial normal mode condition is a condition for printing on the plain sheet in a warm-up stage assumed after powering ON or in a state of being resumed from a sleep mode for power consumption saving. The initial normal mode selects a printing speed equal to that in the thick sheet mode and a preset fixing temperature equal to that in the thin sheet mode. By using the initial normal mode, it is possible to start printing earlier than printing on the plain sheet in the normal mode and, hence, the user can obtain printed matter earlier.

Figure 4:
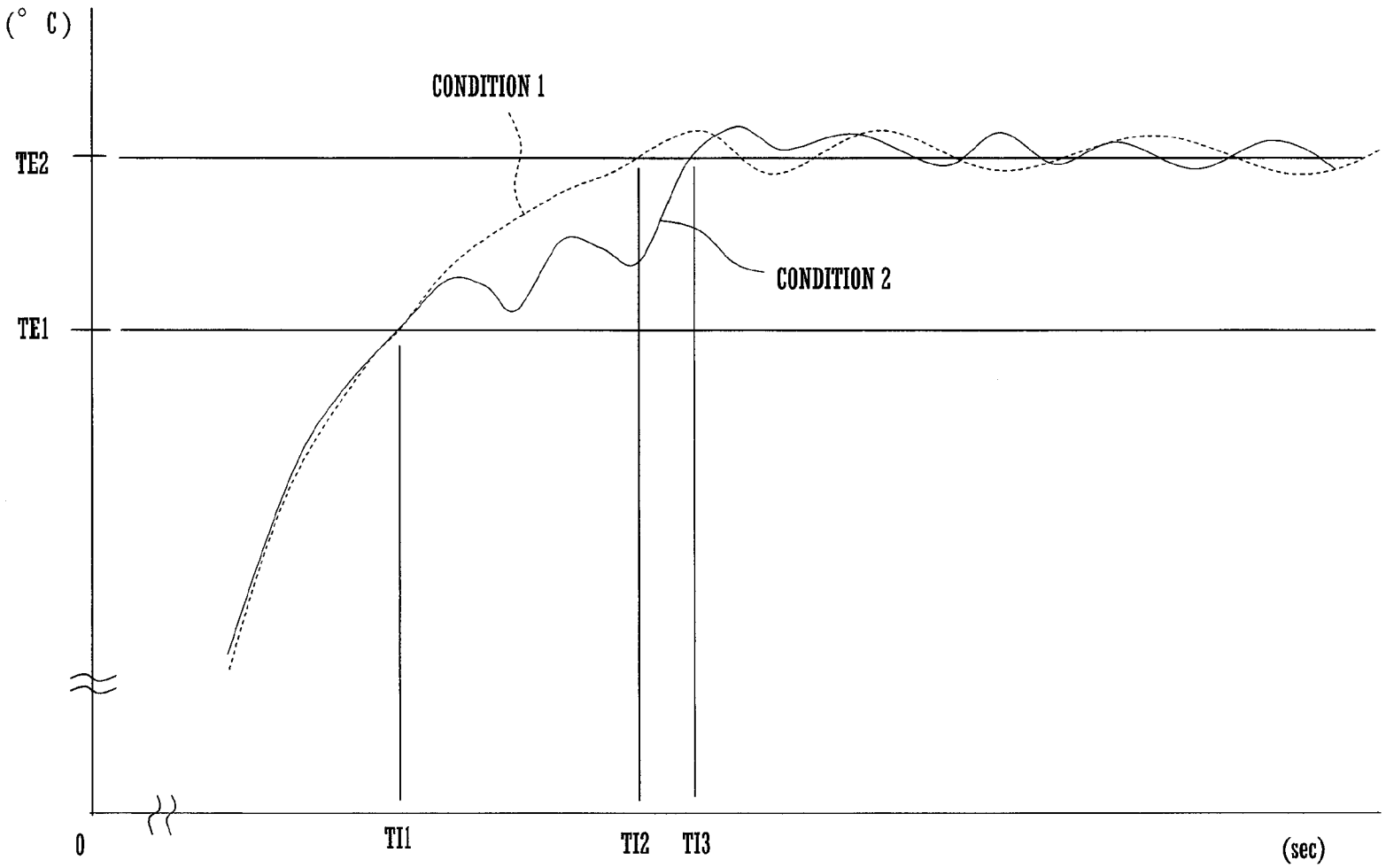
FIG. 4 is a graph plotting changes in the fixing temperature of a fixing device in an image forming apparatus according to an embodiment of the present invention.

FIG. 4 is a graph plotting changes in the fixing temperature of a fixing device in an image forming apparatus according to an embodiment of the present invention.

FIG. 4 shows changes in fixing temperature under a condition that printing on the plain sheet is performed in the normal mode (condition 1) and changes in fixing temperature under a condition that printing on the plain sheet is performed in the initial normal mode and then in the normal mode (condition 2). On the axis representing time, TI1, TI2 and TI3 indicate 30 s, 60 s and 65 s, respectively. On the axis representing temperature, TE1 and TE2 indicate 165° C. and 185° C., respectively.

Under condition 1, the surface temperature reaches temperature TE1 after lapse of time TI1 from the start of energization of the heater lamp 33 and then reaches temperature TE1 after lapse of time TI2 from the start of energization of the heater lamp 33. Therefore, it takes 60 s for the apparatus to become ready for printing on the plain sheet in the normal mode. For this reason, the user has to wait for 60 s without being able to do something and hence becomes impatient.

Under condition 2, by contract, the surface temperature reaches temperature TE1 after lapse of time TI1 from the start of energization of the heater lamp 33 and, whereupon, a control for enabling printing to be performed on the plain sheet starts. Therefore, it is possible to start printing in one half of the time required under condition 1. For this reason, the user does not become impatient.

When printing starts under condition 2 at the time the surface temperature TE1 is reached, the rise in surface temperature stops temporarily, but the rising tend of the surface temperature can be maintained because the fixing roller 31 is given a larger amount of heat than a loss of heat caused by printing. This can be expressed by the formula: $Q1=Q2+\alpha$ ($\alpha>0$) wherein: Q1 represents the amount of heat given to the surface of the fixing roller 31 by the heater lamp 33 during a period from a point in time immediately before printing on the first sheet to a point in time immediately before printing on the second sheet or a period from the point in time immediately before printing on the second sheet to a point in time immediately before printing on the third sheet; Q2 represents the amount of heat absorbed by the first or second sheet from the surface of the fixing roller 31; and $\alpha$ represents the difference between Q1 and Q2. The surface temperature of the fixing roller 31 rises by $\alpha$. Therefore, as compared with printing under condition 1 under which printing does not start until the surface temperature reaches TE2, the time required for the surface temperature reaches temperature TE2 under condition 2 is TI3, which is slightly longer than TI2. Thus, condition 2 allows the preparatory start-up stage to be utilized effectively.

Under condition 2, printing at a low printing speed starts at the time the surface temperature of the fixing roller reaches TE1. However, because the surface temperature of the fixing roller 31 reaches TE2 after printing on two or three sheets or so, printing at the normal printing speed becomes possible thereafter.

Figure 5:
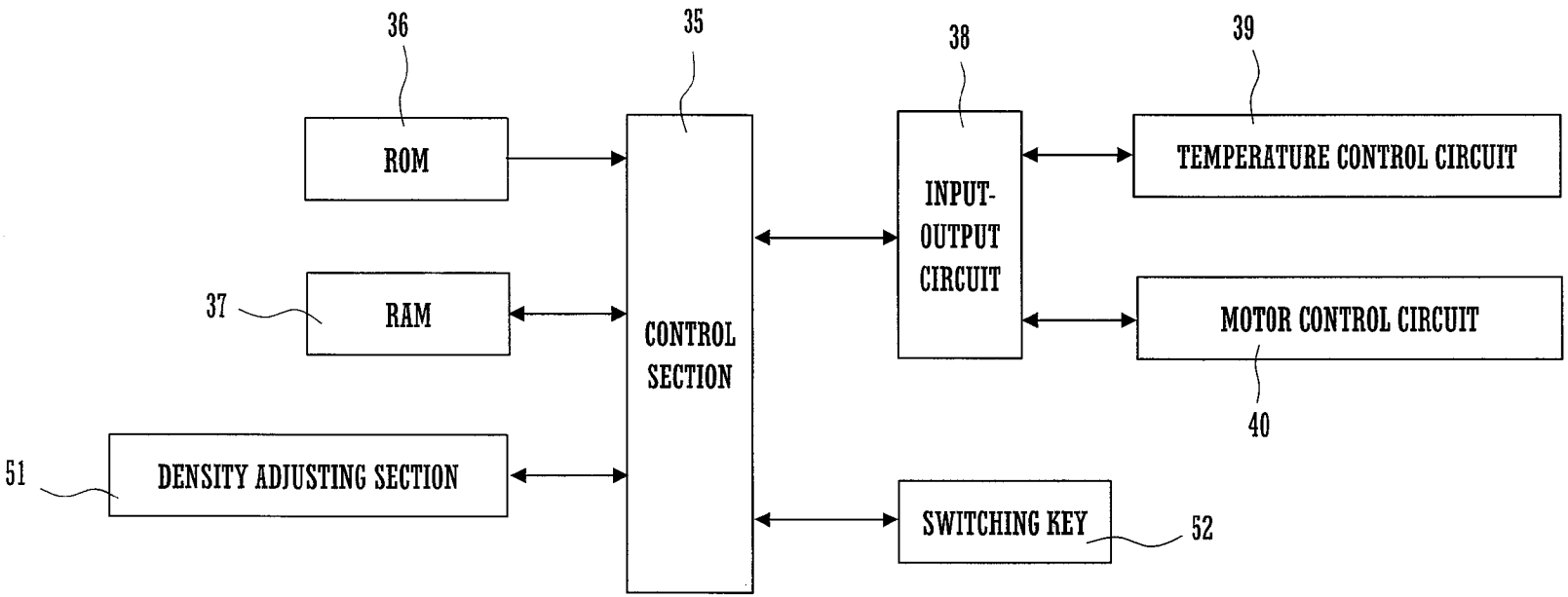
FIG. 5 is a block diagram showing a control system of an image forming apparatus according to an embodiment of the present invention.

FIG. 5 is a block diagram showing a control system of an image forming apparatus according to an embodiment of the present invention.

A control section 35 is connected to ROM 36, RAM 37, input-output circuit 38, density adjusting section (i.e., adjusting section) 51, and switching key 52. The control section 35 controls image forming operations of the overall image forming apparatus 100. For this purpose, control programs are pre-stored in the ROM 36. By sequentially reading the programs stored in the ROM 36, the control section 35 controls the image forming operations sequentially. In addition to the ROM 36, there is provided the RAM 37 for storing therein data required for the controls, information about image forming conditions, and the like at any time. In the present invention, the RAM 37 has a storage area forming a timer for controlling the fixing heater, a working area for storing data inputted from various sensors, an area for storing information about image forming conditions, the number of printed sheets to be outputted and the like, and a like area. Thus, the RAM 37 is capable of storing information about progressing status of the image forming operation.

The control section 35 receives signals from various input keys and sensors provided in the image forming apparatus 100 via the input-output circuit 38 and causes the RAM 37 to store data or information provided by the signals in an appropriate area thereof when necessary. In response to an instruction to output, the control section 35 causes the apparatus to perform the image forming operations sequentially based on the data or information stored in the RAM 37. In response to powering ON or resuming a state from the sleep mode, the control section 35 receives input of information about that operation via the input-output circuit 38 and then controls a temperature control circuit 39 for start-up control. In response to a start-up instruction received from the control section 35, the temperature control circuit 39 starts energizing the heater lamp 33 to perform a start-up operation for raising the temperature of the fixing roller 31 up to a temperature which allows fixing to be achieved. That is, the warm-up operation is performed.

When data on the surface temperature of the fixing roller 31 is inputted to the control section 35 via the temperature detection sensor 34, the control section 35 informs the temperature control circuit 39 of the surface temperature inputted. In this case, an arrangement is possible such that the temperature control circuit 39 is configured to receive input of a temperature detection signal from the temperature detection sensor 34 thereby to perform a direct temperature control. For this purpose, it is possible that the temperature control circuit 39 is provided with a slave CPU while the control section 35 used as a master CPU in performing controls.

The temperature control circuit 39 performs an energization control over the heater lamp 33 so as to keep the surface of the fixing roller 31 at a preset temperature which allows fixing to be achieved in accordance with the temperature detected by the temperature detection sensor 34.

Along with the temperature control circuit 39, a motor control circuit (i.e., driving member control section) 40 is provided for controlling rotation of the fixing roller 31 of the fixing device 3. The motor control circuit 40 switches the rotating operation and speed of the fixing roller 31 to meet the start-up process for the fixing device 3 in response to an instruction provided by the control section 35 when necessary.

In response to a control instruction, for example, a driving start instruction, from the control section 35, the motor control circuit 40 controls the motor so that the fixing roller 31 of the fixing device 3 rotates. At that time, the rotating speed of the fixing roller 31 is set to a predetermined speed. Specifically, the predetermined speed is a speed at which the plain sheet is fed or a lower speed at which the thick sheet is fed and is equal to the printing speed of the image forming apparatus 100.

The density adjusting section 51 is configured to adjust the density of an image to be developed on a printing sheet. In the warm-up stage assumed after the image forming apparatus 100 has been powered ON or in a state of being resumed from the sleep mode, the density adjusting section 51 adjusts the density of the image to be developed on the printing sheet to a low value. Printing on a printing sheet starts under the condition that the surface temperature of the fixing roller 31 is lower than a normal temperature in the warm-up stage assumed after the image forming apparatus 100 has been powered ON or in the state of being resumed from the sleep mode. By adjusting the density of the image to be developed on the printing sheet when the apparatus is in such a condition, it is possible to reduce the amount of toner to be used on the printing sheet, thereby to suppress the occurrence of a fixing failure due to an insufficient fixing temperature.

The switching key 52 is a key enabling switching to be made between preset fixing temperatures. The switching key 52 is disposed at such a location as to allow the user to depress the switching key 52, for example, a location in the vicinity of an operation panel of the image forming apparatus 100. In the present embodiment, when an instruction to perform printing on a printing sheet is received under a condition that the normal mode is alive in the warm-up stage assumed after the image forming apparatus 100 has been powered ON or in the state of being resumed from the sleep mode, the printing operation starts after the printing speed of the fixing roller 31 has been set lower than the preset normal speed and after the fixing temperature of the fixing roller 31 has been set to a preset fixing temperature that is lower than the preset normal temperature. If the user depresses the switching key 52 at that time, the preset fixing temperature can be switched to the preset normal temperature. Thus, printing a developed image in a normal density can be performed though the waiting time until the start of the printing operation increases.

Figure 6:
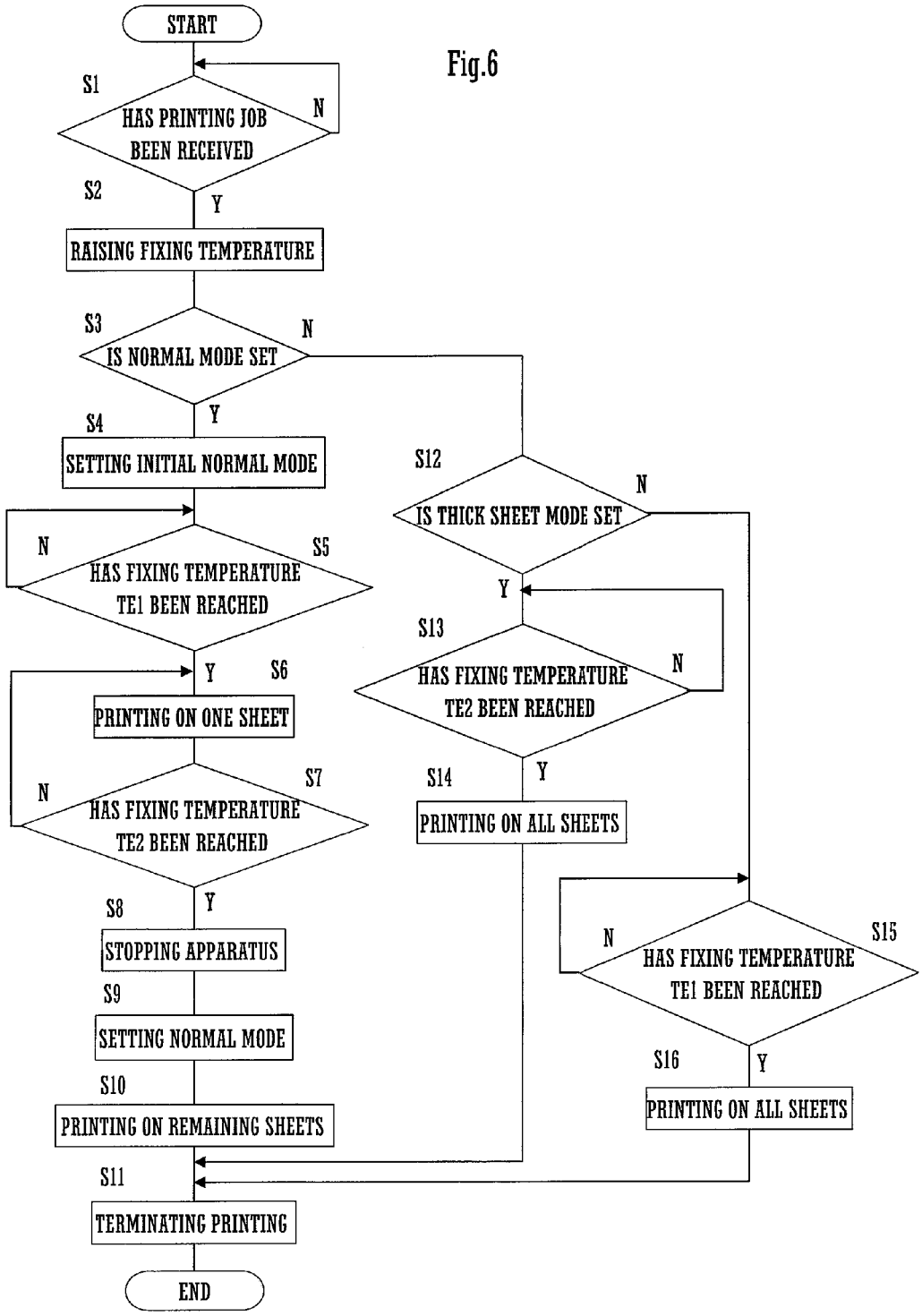
FIG. 6 is a flowchart showing a printing process carried out by an image forming apparatus according to an embodiment of the present invention.

FIG. 6 is a flowchart showing a printing operation performed by an image forming apparatus according to an embodiment of the present invention.

FIG. 6 illustrates a printing operation performed in the state of being resumed from the sleep mode.

The control section 35 waits until a printing job is specified (N in step S1). If the control section 35 determines that the printing job has been received from a personal computer or the like (Y in step S1), the control section 35 energizes the heater lamp 33 to raise the fixing temperature in order to resume operation from the sleep mode (step S2). Thereafter, the control section 35 checks the contents of the printing job (step S3). Specifically, the control section 35 checks which of the printing modes is set on the printing job. If the control section 35 determines that the normal mode is set on the printing job (Y in step S3), the control section 35 sets the printing mode to the initial normal mode (step S4). Thereafter, if the control section 35 determines that the fixing temperature has reached TE1 (Y in step S5), the control section 35 causes the apparatus to perform printing on one printing sheet (step S6). If the control section 35 determines that the fixing temperature has not reached TE2 yet (N in step S7), the process returns to step S6. If the control section 35 determines that the fixing temperature has reached TE2 (Y in step S7), the control section 35 causes the image forming apparatus 100 to halt (step S8). Then, the control section 35 switches the initial normal mode to the normal mode (step S9). Thereafter, the control section 35 causes the apparatus to perform printing on all the remaining printing sheets (step S10) and then terminate printing (step S11).

If it is determined in step S3 that the normal mode is not set (N in step S3), the control section 35 determines whether or not the thick sheet mode is set (step S12). If the control section 35 determines that the thick sheet mode is set (Y in step S12), the control section 35 waits until the fixing temperature reaches TE2 (N in step S13). If the control section 35 determines that the fixing temperature has reached TE2 (Y in step S13), the control section 35 causes the apparatus to perform printing on all the printing sheets (step S14) and then terminate printing (step S11).

If it is determined in step S12 that the thick sheet mode is not set, the control section 35 waits until the fixing temperature reaches TE1 (N in step S15). If the control section 35 determines that the fixing temperature has reached TE1 (Y in step S15), the control section 35 causes the apparatus to perform printing on all the printing sheets (step S16) and then terminate printing (step S11).

While description has been directed to the printing operation performed in the state of being resumed from the sleep mode according to the present embodiment, the present embodiment can perform a printing operation similarly in the stage assumed after the apparatus has been powered ON.

Figure 7:
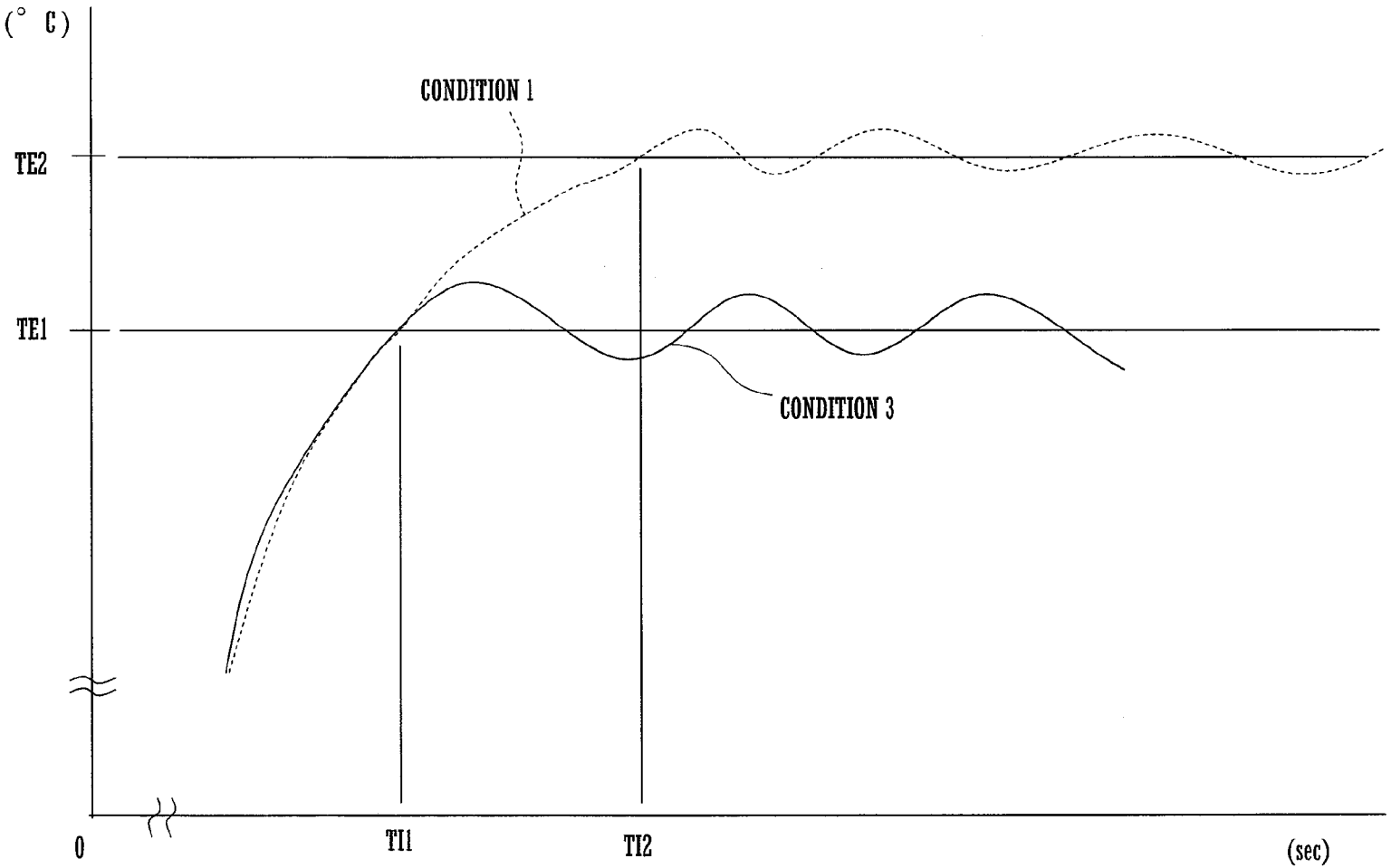
FIG. 7 is a graph plotting changes in the fixing temperature of a fixing device in an image forming apparatus according to a second embodiment of the present invention.

FIG. 7 is a graph plotting changes in the fixing temperature of a fixing device in an image forming apparatus according to a second embodiment of the present invention.

Unlike the first embodiment, the present embodiment is capable of setting a power saving mode. The power saving mode is a printing mode in which both the fixing temperature and the printing speed are low. Specifically, the fixing temperature and the printing speed in the power saving mode are 165° C. and 125 mm/s, respectively. In the initial normal mode the fixing temperature rises to reach the preset normal temperature during printing on plain sheets, whereas in the power saving mode the fixing temperature does not reach the preset normal temperature and is kept relatively low. The power saving mode is a mode for printing on a small number of printing sheets.

FIG. 7 shows changes in fixing temperature under a condition that printing on plain sheets is performed in the normal mode (condition 1) and changes in fixing temperature under a condition that printing on plain sheets is performed in the power saving mode (condition 3). On the axis representing time, TI1 and TI2 indicate 30 s and 60 s, respectively. On the axis representing temperature, TE1 and TE2 indicate 165° C. and 185° C., respectively.

Under condition 1, the surface temperature reaches temperature TE1 after lapse of time TI1 from the start of energization of the heater lamp 33 and then reaches temperature TE2 after lapse of time TI2 from the start of energization of the heater lamp 33. Therefore, it takes 60 s for the apparatus to become ready for printing on a plain sheet. For this reason, the user has to wait for 60 s without being able to do something and hence becomes impatient.

Under condition 3, by contract, the surface temperature reaches temperature TE1 after lapse of time TI1 from the start of energization of the heater lamp 33 and, whereupon, a control starts such that printing on the plain sheets becomes possible. Therefore, it is possible to start printing in one half of the time required for printing to start under condition 1. For this reason, the user does not become impatient.

When printing starts under condition 3 at the time the surface temperature TE1 is reached, the rise in surface temperature stops. The surface temperature is kept at about TE1 because the fixing roller 31 is given an amount of heat substantially equal to a loss of heat caused by printing. This can be expressed by the formula: $Q3 \approx Q4$ wherein: Q3 represents the amount of heat given to the surface of the fixing roller 31 by the heater lamp 33 during a period from a point in time immediately before printing on the first sheet to a point in time immediately before printing on the second sheet or a period from the point in time immediately before printing on the second sheet to a point in time immediately before printing on the third sheet; Q4 represents the amount of heat absorbed by the first or second sheet from the surface of the fixing roller 31. Thus, the surface temperature of the fixing roller 31 is kept substantially constant.

Under condition 3, printing is performed with the surface temperature of the fixing roller 31 falling below TE2. However, since condition 3 is the mode for printing on a small number of printing sheets, a low printing speed is sufficient. Further, since the surface temperature of the fixing roller 31 is kept relatively low, printing can be performed with reduced power consumption.

Figure 8:
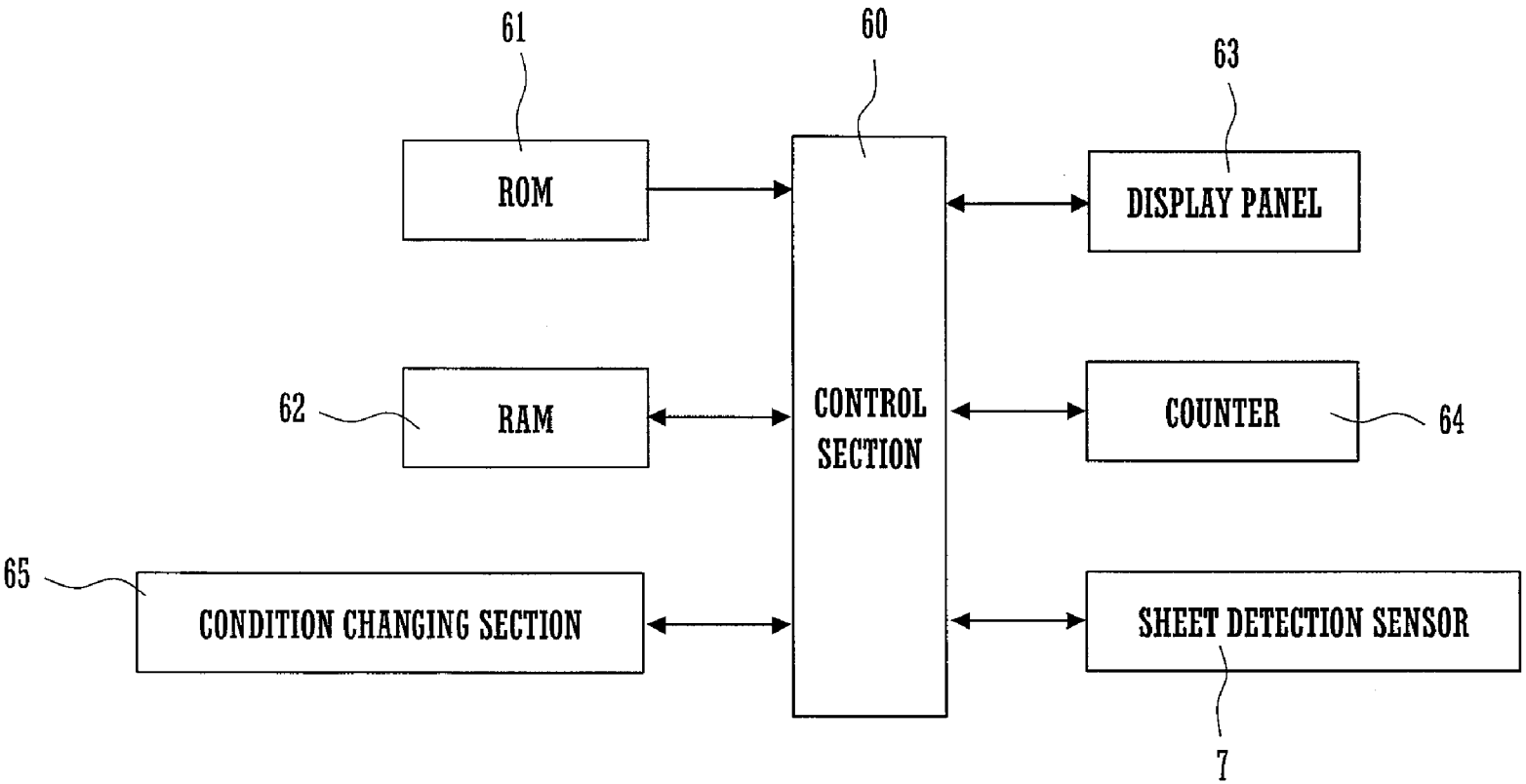
FIG. 8 is a block diagram showing a control system of the image forming apparatus according to the second embodiment of the present invention.

FIG. 8 is a block diagram showing a control system of the image forming apparatus according to the second embodiment of the present invention.

A control section 60 is connected to ROM 61, RAM (i.e., storage section) 62, display panel (i.e., display section) 63, counter (i.e., counting section) 64, and condition changing section 65. The control section 60 controls image forming operations of the overall image forming apparatus 100. For this purpose, control programs are pre-stored in the ROM 61. By sequentially reading the programs stored in the ROM 61, the control section 60 controls the image forming operations sequentially. In addition to the ROM 61, there is provided the RAM 62 for storing therein data required for control, information about conditions for image formation, and the like at any time. In the present invention, the RAM 62 has a storage area forming a timer for controlling the fixing heater, a working area for storing data inputted from various sensors, an area for storing information about image forming conditions, the number of printed sheets to be outputted and the like, an area for storing a number counted by the counter 64, and a like area. Thus, the RAM 62 is capable of storing information about progressing status of the image forming operation. The RAM 62 may be nonvolatile memory which retains stored data even when the power to the image forming apparatus 100 is cut off.

The display panel 63 displays a current printing mode and the like. Thus, the user can be informed of a current status of use. The counter 64 counts the number of printing sheets having been subjected to printing by a one-time printing instruction as the number of printing sheets subjected to successive printing. Such printing sheets are detected by the sheet detection sensor 7 and recognized by the counter 64. Data on the number of printing sheets counted by the counter 64 is transferred to the RAM 62 via the control section 60 and stored therein. When data on the number of printing sheets counted by the counter 64 is transferred to the RAM 62, the counted number is reset. The condition changing section 65 is capable of changing the condition for switching the normal mode to the power saving mode.

Figure 9:
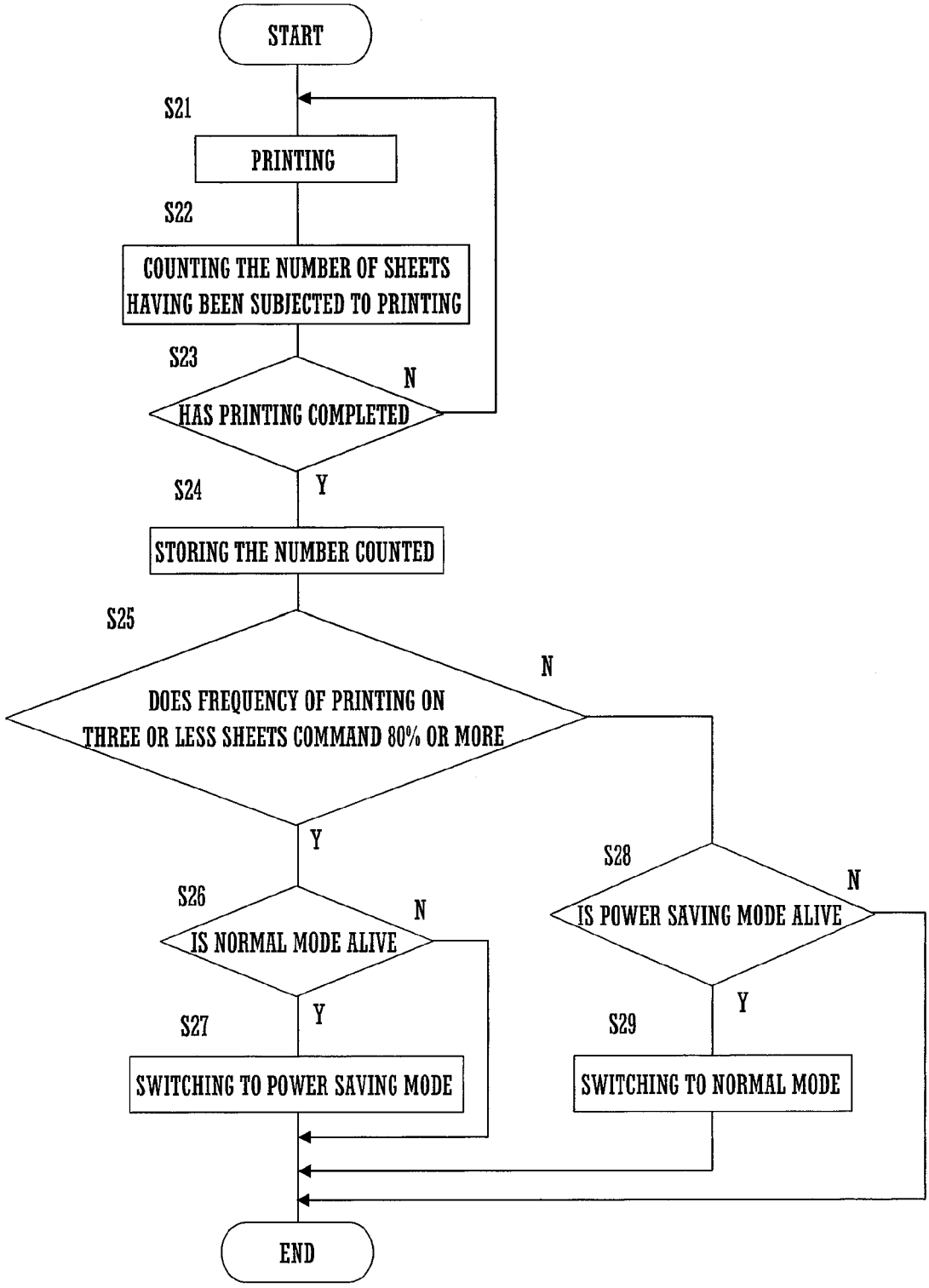
FIG. 9 is a flowchart showing a mode switching process of the image forming apparatus according to the second embodiment of the present invention.

FIG. 9 is a flowchart showing a mode switching process of the image forming apparatus according to the second embodiment of the present invention.

The frequency of printing on three or less printing sheets commands 80% of the frequency of printing by image forming apparatuses handled by users, whereas the frequency of printing on a larger number of printing sheets commands 20% or less. In the case of printing on three or more printing sheets of which the frequency commands 80%, the total power consumption can be reduced substantially by utilizing the power saving mode which allows printing to be performed with reduced power consumption.

The flowchart illustrates the flow of a process for switching between the normal mode and the power saving mode. The following description is directed to the flow of a process carried out after a printing job has been performed.

When printing on printing sheets starts (step S21), the control section 60 causes the counter 64 to count the number of printing sheets having been subjected to successive printing (step S22). If the control section 60 determines that printing has not been completed yet (N in step S23), the process returns to step S21. If the control section 60 determines that printing has been completed (Y in step S23), the control section 60 causes the RAM 62 to store therein the number counted by the counter 64 (step S24). The control section 60 references the data stored in the RAM 62 and switches the current printing mode to the power saving mode (step S27) if it is determined that the frequency of printing on three or less printing sheets commands not less than 80% (Y in step S25) and that the current printing mode is the normal mode (Y in step S26).

The control section 60 switches the current printing mode to the normal mode (step S29) if it is determined that the frequency of printing on three or less printing sheets commands less than 80% (N in step S25) and that the current printing mode is the power saving mode (Y in step S28).

While the case where the frequency of printing on three or less printing sheets having been subjected to successive printing commands not less than 80% is used here as the condition for switching the normal mode to the power saving mode, there is no limitation thereto. For example, by establishing different percentage conditions for respective of monochromatic printing and color printing, the fixing performance of color printing using three or four color toners can be ensured more reliably.

The control section 60 may be configured to reset data stored in the RAM 62 after lapse of a predetermined time period. The control section 60 may be configured to reset either only the data having been stored in the RAM 62 for a predetermined time period or all the data stored therein so far. Such a configuration allows selection of mode to be reflected by the frequency of successive printing on a certain number of printing sheets within a most recent period, thereby making it possible to select a suitable mode.

While both of the first and second embodiments have been directed to the image forming apparatuses each capable of selection from two printing speeds and from two preset fixing temperatures, the control method according to the present invention is applicable to image forming apparatuses offering three or more printing speeds and three or more preset fixing temperatures.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

What is claimed is:

1. An image forming apparatus capable of setting plural printing modes including a normal mode, the image forming apparatus comprising:

a fixing section configured to fix a developing agent image carried on a recording medium onto the recording medium by heat supplied from a heat source, the fixing section having not less than two printing speeds and not less than two preset fixing temperatures;

a temperature control section configured to control a fixing temperature of the fixing section so as to adjust the fixing temperature to a preset fixing temperature;

a display section configured to display a current printing mode being used;

a counting section configured to count for multiple printing jobs the number of recording media having been subjected to successive printing in each of the multiple printing jobs;

a storage section configured to store therein the number counted by the counting section for each of the multiple printing jobs such that multiple numbers of recording media, at least one number of recording media for each of the multiple printing jobs, are stored in the storage section;

a control section configured to carry out a control process including: for a subsequent printing job, setting a power saving mode by selecting a printing speed of the fixing section which is lower than a preset normal speed used in the normal mode while selecting a preset fixing temperature of the fixing section which is lower than a preset normal temperature used in the normal mode when the normal mode is alive while a frequency of successive printing on not more than three recording media is determined, based on the multiple numbers of recording media stored in the storage section, to be a predetermined percentage or more; and a driving member control section configured to switch a current printing speed of the fixing section to a printing speed selected by the control section.

2. The image forming apparatus according to claim 1, wherein the control section performs a control operation such that when the power saving mode is alive while the frequency of successive printing on not more than three recording media is a percentage less than the predetermined percentage, the power saving mode is switched to the normal mode.

3. The image forming apparatus according to claim 1, further comprising a condition changing section which is capable of changing a condition for switching the normal mode to the power saving mode.

4. The image forming apparatus according to claim 1, wherein the control section is configured to reset data stored in the storage section after lapse of a predetermined time period.

* * * * *